US006575389B2

(12) United States Patent
Neely

(10) Patent No.: US 6,575,389 B2
(45) Date of Patent: Jun. 10, 2003

(54) ROTATING CUTTER SYSTEM

(75) Inventor: Phillip K. Neely, Terre Haute, IN (US)

(73) Assignees: Sony Corporation, Tokyo (JP); Digital Audio Disc Corporation, Terre Haute, IN (US)

( * ) Notice: Subject to any disclaimer, the term of this patent is extended or adjusted under 35 U.S.C. 154(b) by 111 days.

(21) Appl. No.: 09/886,816

(22) Filed: Jun. 21, 2001

(65) Prior Publication Data

US 2002/0195506 A1 Dec. 26, 2002

(51) Int. Cl.[7] ..... B02C 13/02
(52) U.S. Cl. ..... 241/27; 241/280; 241/282
(58) Field of Search ..... 241/27, 30, 280, 241/281, 282, 185.5

(56) References Cited

U.S. PATENT DOCUMENTS 3,326,478 A * 6/1967 Van Endert ..... 241/185.5
3,462,088 A * 8/1969 Ionescu ..... 241/185.5
5,405,093 A * 4/1995 Bozarth ..... 241/34
5,509,613 A * 4/1996 Page ..... 241/282
5,927,622 A * 7/1999 Zoellinger ..... 241/27

* cited by examiner

*Primary Examiner*—John M. Husar
(74) *Attorney, Agent, or Firm*—Wood, Herron & Evans, L.L.P.

(57) ABSTRACT

An apparatus for destroying articles that has a cutter rotatably mounted adjacent a feed opening of a chamber containing articles to be destroyed. A ram is mounted in the chamber and is movable in a first direction toward the cutter. A plate forms the bottom surface of the chamber, and the plate has a plurality of grooves extending in the first direction. A wiper is mounted on the front of the ram, and the wiper has a plurality of teeth located in respective grooves in the plate. Thus, the plurality of teeth in the grooves prevent articles from sliding beneath the ram as it pushes articles into the cutter. In another embodiment, a segmented wiper is mounted on a first side wall, the segmented wiper has a length extending across an irregular upper surface of the ram, the segmented wiper further has a plurality of independently movable wiper teeth that are in substantially continuous contact with the irregular upper surface of the ram. Thus, the segmented wiper prevents articles from sliding between the irregular upper surface of the ram and the first side wall as the ram pushes articles into the cutter.

24 Claims, 4 Drawing Sheets

ROTATING CUTTER SYSTEM

FIELD OF THE INVENTION

This invention relates to material handling and more particularly, to improvements to a machine disposing of articles, for example, optical discs.

BACKGROUND OF THE INVENTION

In many production environments, articles are often produced in batches for particular customers. Although a customer orders a desired quantity of articles, in some applications, it is normal practice to run a batch of articles that is in excess of the desired quantity. Thus, as the articles proceed through the various steps of the production process, if lesser quality or scrap articles are produced, the batch will still have a net yield of articles that is sufficient to ship the desired quantity to the customer. Further, most often, the batch will yield a quantity of good, high quality articles that is in excess of the desired quantity, and those excess articles potentially have full market value. Depending on the articles, their unauthorized distribution may potentially create a liability for the manufacturer. For example, if the articles are optical discs that contain copyrighted music and/or movies, an unauthorized distribution or sale of such excess production discs may be illegal. Therefore, if the excess production discs cannot be sold to the customer, the manufacturer normally disposes of the excess quantity of optical discs. At a minimum, a manufacturer normally destroys the readability of the discs prior to disposal.

There are currently many ways of destroying the readability of optical discs, for example, they can be heated, spindled, cut, mutilated, shredded, microwaved, etc. After destroying their readability, the optical discs can be disposed of in any known manner. It may also be desirable that the process of destroying the readability of the optical discs facilitate a recycling of the optical disc material. Therefore, in facilitate a recycling process, it is desirable to grind, cut or shred the excess optical discs into smaller pieces. However, known commercial equipment capable of physically grinding or shredding optical discs is not conducive to the automatic feeding of optical discs therethrough. Finished optical discs are 1.2 millimeters thick and half discs are 0.6 millimeters thick. These very thin discs are difficult to reliably move along flat surfaces, and they have a tendency to slide under moving parts out of the working volume of the machine. Such discs not only avoid destructive action but can potentially interfere with the proper operation of the machine.

Consequently, there is a need for an article destroying machine that is more reliable and efficient in its handling of very thin articles.

SUMMARY OF THE INVENTION

The present invention provides an improved machine for the handling and destroying of thin articles such as optical discs. The apparatus of the present invention improves the feeding of optical discs through a hopper and into an article cutter, thereby shredding the optical disc into smaller pieces. The apparatus of the present invention prevents thin optical discs from escaping from a working volume of the machine. Thus, the apparatus of the present invention is especially useful for those applications in which the optical discs contain copyrighted material and failure to destroy the discs may result in a liability to the manufacturer.

According to the principles of the present invention and in accordance with the preferred embodiments, the invention provides an apparatus for destroying articles that has a cutter rotatably mounted adjacent a feed opening of a chamber containing articles to be destroyed. A ram is mounted in the chamber and is movable in a first direction toward the cutter. A plate forms the bottom surface of the chamber, and the plate has a plurality of grooves extending in the first direction. A wiper is mounted on the front of the ram, and the wiper has a plurality of teeth located in respective grooves in the plate. Thus, the plurality of teeth in the grooves prevent articles from sliding beneath the ram as it pushes articles into the cutter.

In one aspect of the invention, the apparatus further comprises a segmented wiper mounted on a first side wall, the segmented wiper has a length extending across an irregular upper surface of the ram. The segmented wiper further has a plurality of independently movable wiper teeth that are in substantially continuous contact with the irregular upper surface of the ram. Thus, the segmented wiper prevents articles from sliding between the irregular upper surface of the ram and the first side wall as the ram pushes articles into the cutter.

These and other objects and advantages of the present invention will become more readily apparent during the following detailed description taken in conjunction with the drawings herein.

DETAILED DESCRIPTION OF THE INVENTION

Figure 1A:
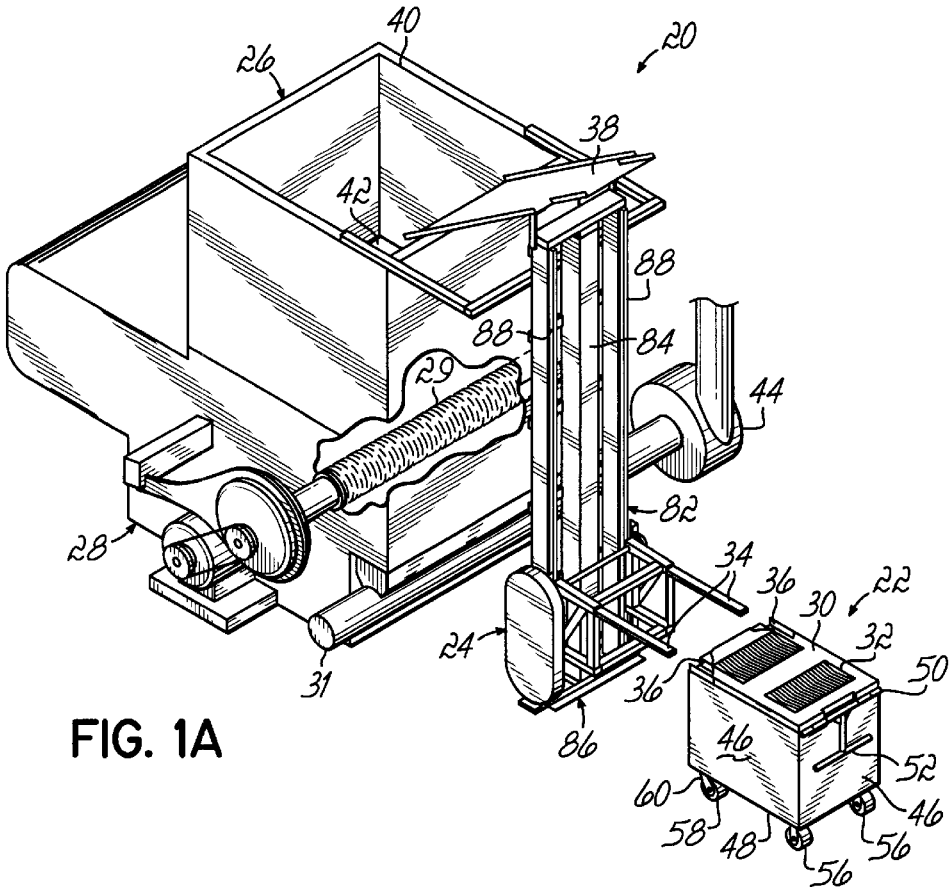
FIG. 1A is a perspective view of a disposal system for articles in which the apparatus of the present invention is a component part.

Referring to FIG. 1A, a secure disposal system 20 for articles is comprised of a mobile cart 22, a transfer device 24, an article accumulator or hopper 26 and an article destroyer 28. In the illustrated example, the article destroyer 28 has a cutting or grinding tool 29 that grinds the articles into small pieces that drop into a collector 31. The ground optical disc material in the collector 31 is transported away from the article disposal system 20 by a pneumatic transfer system 44. In many manufacturing environments, scrap articles are produced in the normal course of production. In other environments, for example, in the production of optical discs containing audio and video material, overrun production is common. The secure disposal system 20 of FIG. 1A is especially useful for collecting and destroying nondefective, good articles or discs that have a commercial value and the unauthorized distribution and sale of which may be illegal.

The wheeled cart 22 has a hinged cover or lid 30 that is normally secured in its illustrated, closed position. The cover 30 has slots or openings 32 that permit articles, in this example, optical discs, to be loaded into the cart 22. The cart 22 is manually or automatically moved to various production stations, and overproduction and/or scrap optical discs are inserted through the openings 32 and dropped into the cart 22. After the discs have been loaded into the cart 22, the automatic securing or locking of the cover 30 to the cart 22 prohibits removal of the discs. Thus, the cart 22 is a secure facility for storing the articles or discs therein.

At appropriate times, the cart 22 is moved into juxtaposition with the transfer device 24. The transfer device 24 has a pair of lift arms 34 that are sized to be received by hollow members or rails 36 on the cart 22. As will subsequently be described in detail, insertion of the arms 34 into the hollow rails 36 automatically unlocks the cover 30, thereby permitting the cover 30 to pivot freely with respect to the cart 22. After the cart 22 is mounted on, or coupled or engaged with, the transfer device 24, the transfer device 24 raises the lift arms 34 and the cart 22. The lift arms 34 and cart 22 are then rotated to a position illustrated in FIG. 1B. With the cart in its inverted position, the cover 30 falls open; and the articles in the cart 22 drop onto a chute or ramp 38 and then, drop through a first opening 40 of the article accumulator or hopper 26. The articles then pass through a second hopper opening 42 and into the article destroyer 28.

Figure 2:
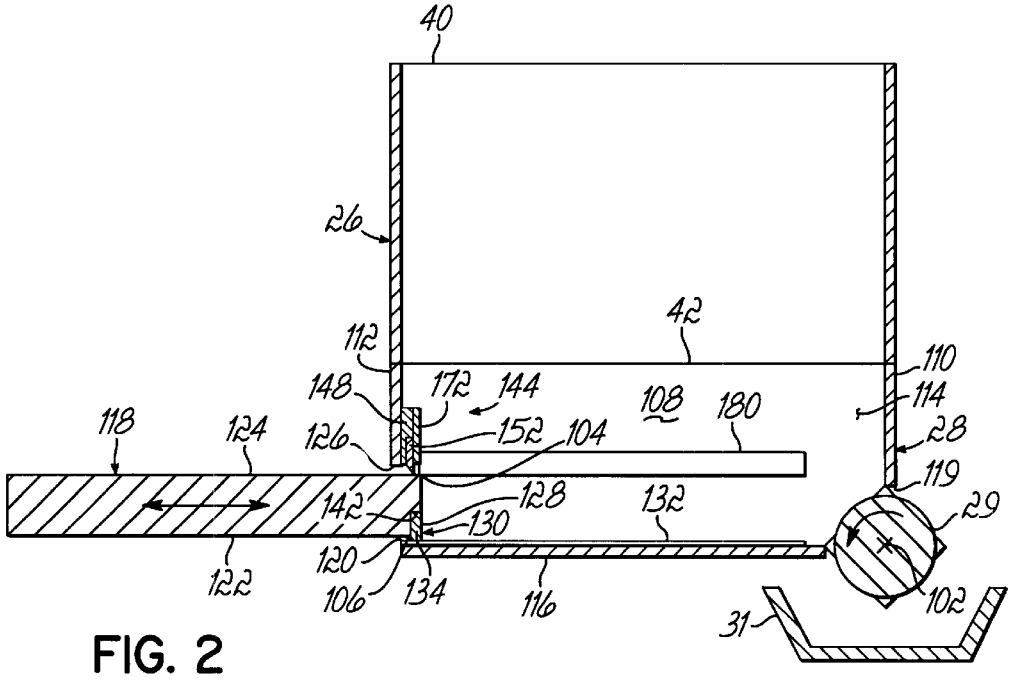
FIG. 2 is a schematic diagram of a cutting apparatus in accordance with the principles of the present invention.

One example of an article destroyer 28 is a rotary grinder model RG 42EW commercially available from ReTech Industries, Inc. of High Point, N.C. Such a rotary grinder is schematically illustrated in FIG. 2. The hopper 26 sits on top of the article destroyer 28 and feeds articles into a throat or chamber 108. The chamber 108 has a front wall 110, a rear wall 112, a pair of opposed sidewalls 114 and a bottom wall 116. A ram 118 is disposed adjacent the bottom 116 and extends through an opening 120 of the rear wall 112. The cutting tool 29 is located adjacent a feed opening 119 through which articles are fed into the rotating cutting or grinding tool 29. The opening 119, cutting tool 29, ram 118 and opening 120 normally have a dimension that extends across a full width of the bottom wall 116, that is, in a direction parallel to the axis of rotation 102. Therefore, as the ram 118 is moved over the bottom wall 116, all of the articles in front of the ram 118 between the sidewalls 114 are pushed across the bottom of the chamber 108 toward the cutting tool 29. The ram 118 is reciprocated in a first direction toward and away from the cutting tool 29 by a power source, for example, a hydraulic fluid power source, in a known manner.

As previously discussed, if the articles to be destroyed are relatively thin, for example, optical discs, they have a tendency to slide between a lower surface 122 of the ram and the bottom surface 116 of the chamber 108. Some of those discs will slide through the opening 120 and drop inside the housing structure surrounding the ram 18 and cutting tool 29. Such optical discs may eventually drop to the floor of the production area. Similarly, other discs may slide between an upper surface 124 of the ram 18 and a lower edge 126 of the rear wall 112. Again, those optical discs may drop into the structure surrounding the ram 118 and the cutting tool 29 and eventually drop to the production floor. In other situations, it is possible for several optical discs to wedge between the bottom surface 122 of the ram 118 and the bottom 116 of the chamber 108. In that situation, the several discs tend to raise the forward side 128 of the ram 118. Any tendency of the forward side 128 of the ram 118 to raise, facilitates the sliding of more optical discs into the space between the bottom surface 122 of the ram and the bottom 116. Such action further increases the wedging effect tending to raise the front side 128 of the ram 118, and it may eventually result in the ram 118 becoming jammed in an inoperative state.

A seal 130 is used to prevent articles or optical discs from sliding between the ram bottom surface 122 and the bottom 116. A first embodiment of the seal 130 is comprised of a plate 132 and a wiper 134. The wiper 134 is mounted to the ram front surface 128 either, removably with fasteners or, more permanently with adhesives or by welding. The wiper 134 is normally mounted in a recess or notch 142 in the ram front surface 128. The wiper 134 can be made of any appropriate material but is normally made of a hard rigid material, for example, steel bar stock. The plate 132 may be made of any appropriate material but is normally a rigid hard material, for example, cold rolled steel nominally 0.25 inches thick.

Figure 3:
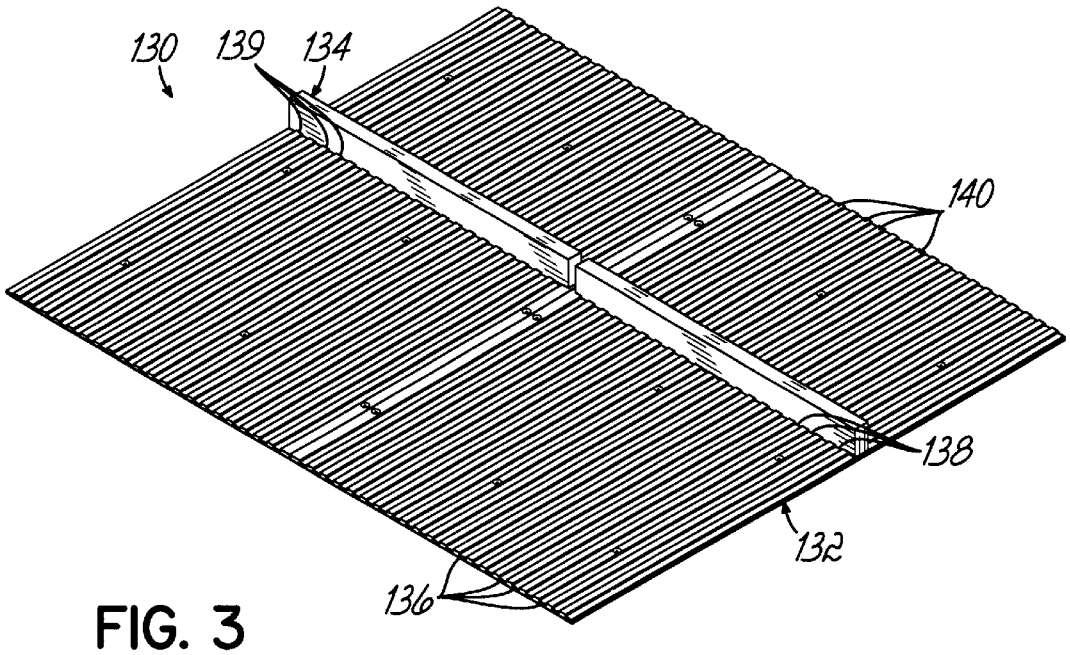
FIG. 3 is a perspective view illustrating one embodiment of a seal for use with the cutting apparatus of FIG. 2.

Referring to FIG. 3, the plate 132 has a plurality of spaced apart depressions, grooves or channels 136. The grooves 136 extend in the first direction generally parallel to the reciprocating motion of the ram 118. Further, the wiper 134 has a like plurality of teeth 138 that are disposed into the depressions 136. The grooves 136 may have a varied size, spacing and depth. However, for ease of manufacture, the grooves normally are uniformly sized, spaced, for example, every 1.00 inch, and are uniformly deep, for example, 0.125 inches. The grooves 136 are illustrated as having a generally rectilinear cross-sectional profile as would be formed by an end mill. With such uniformity, the same end mill can be used to form the grooves 136 and the spaces 139 between the teeth 138 on the wiper 134. The shape of the cross-sectional profile of the grooves 136 can also be curvilinear as can the cross-sectional profile of the wiper teeth 138. Further, it is not mandatory that the cross-sectional profile of the wiper teeth 138 perfectly match the cross-sectional profile of the plate grooves 136. They only have to match to the extent that articles lying on the upper surface 140 of the plate 132 cannot slide between the wiper teeth 138 and the top surface 140 of the plate 132.

Although shown as sealing the lower, forward edge 106 of the ram 118, the first seal 130 may be also used to seal an upper, forward edge 104 of the ram 118. In that application, the plate 132 is fastened to the ram top surface 124 and the wiper 134 is mounted to the rear wall 112 such that the teeth 138 of the wiper 134 are disposed in the grooves of the plate 132.

Figure 4:
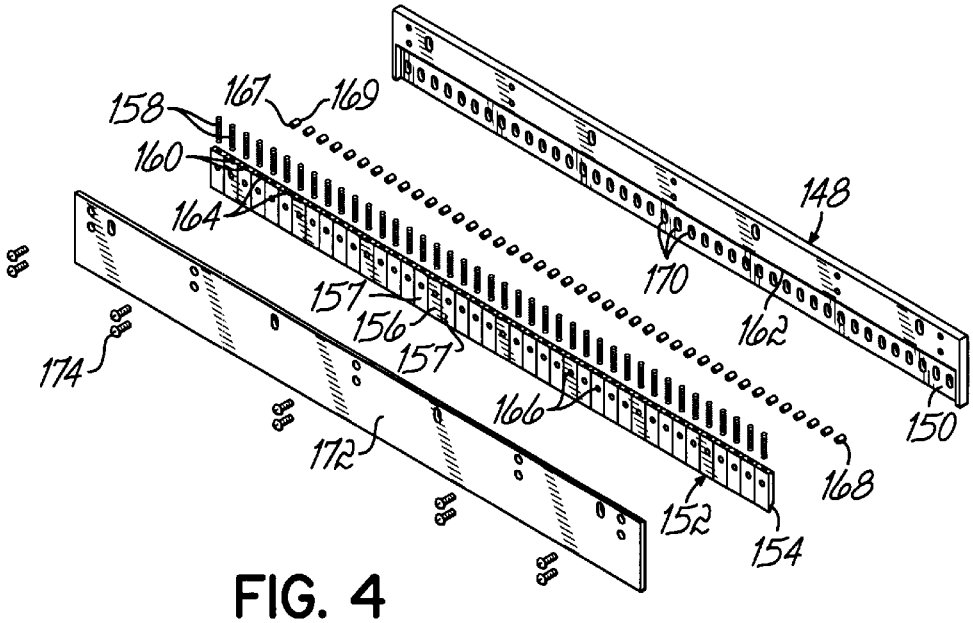
FIG. 4 is a disassembled perspective view of an alternative embodiment of a seal for use with the cutting apparatus of FIG. 2.

In some applications, the available space may not permit the first seal 130 to be utilized. In those applications, a second, segmented seal 144 having a plurality of wiper teeth 152 can be used. Referring to FIG. 4, the second seal 144 includes a base plate 148 having a cavity 150. A plurality of wiper teeth 152 are disposed in the cavity 150 in a side-by-side arrangement. Thus, any one of the wiper teeth 156 is independently movable with respect to its immediately adjacent wiper teeth 157. Each of the wiper teeth 152 has a chamfer 154 on its lower end so that the area of contact between the end of each of the wiper teeth and the ram upper surface 124 is minimized. The wiper teeth can be made from any suitable hard material, for example, a semihard tool steel of about 30 Rc.

A plurality of biasing elements 158, for example, compression springs, are disposed between upper surfaces 160 of the wiper teeth 152 and a lower surface 162 of the base plate cavity 150. The biasing elements 160 can be appropriately located by holes or dimples 164 on the surfaces 160 and/or the surface 162. Thus, each of the wiper teeth 152 is biased toward the ram upper surface 124. As shown in FIG. 2, with the segmented seal 144 mounted on the rear wall 112, the wiper teeth 152 are biased in a direction substantially perpendicular to the ram upper surface 124.

The reciprocating motion of the wiper teeth 152 is guided and limited by a plurality of guide pins 168, for example, rolled pins, that have one end 167 mechanically coupled to one of the wiper teeth 152. In this example, each of the wiper teeth has an opening or hole 166 that receives an end 167 of a respective guide pin 168 with an interference fit. The opposite ends 169 of the pins 168 are disposed in openings 170 in the backing plate 148. Normally, the openings 170 are slots having a slot width that permits the pins 168 to slide therein. The slots have a length about equal to a desired magnitude of the displacement of the wiper teeth 152 with respect to the ram upper surface 124. Thus, the guide slots 170 function to limit the motion of the guide pins 168 and their respective wiper teeth 152. A cover plate 172 covers the wiper teeth 152 and biasing elements 158. The cover plate 172 is secured to the backing plate 148 by fasteners 174, thereby securing the components of the second seal 144 in an operable assembly.

When mounted on the rear wall 112, the segmented seal 144 is oriented such that the chamfer 154 of the wiper teeth 152 is directed toward the outside of the chamber 108. Thus, the side-by-side arrangement of wiper teeth 152 presents a flat vertical surface that optical discs have a great difficulty displacing. Further, the segmented seal 144 accommodates an absence of flatness often found on the ram top surface 124. In addition, the segmented seal 144 maintains continuous contact with the ram upper surface 124 even when the ram 118 does not move in a true horizontal plane. Thus, the segmented seal 144 maintains continuous contact with the ram upper surface 124 independent of irregularities in surface flatness and slight variations in the desired horizontal orientation and motion of the ram 118. Although, in FIG. 2, the segmented seal 144 is shown as being applied to the opening 120 between the rear wall lower edge 126 and the ram upper surface 124, the segmented seal 144 may also be used in place of the first seal 130. In that embodiment, the segmented seal 144 would be mounted within the notch 142 with the wiper teeth 152 contacting the upper surface of the bottom 116.

Figure 5:
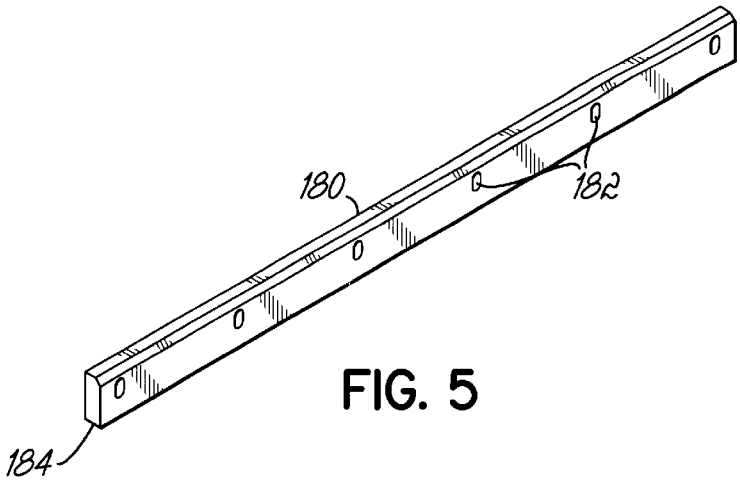
FIG. 5 is a perspective view of a guide bar for use with the cutting apparatus of FIG. 2.

During reciprocation of the ram 118, it is important that its motion be substantially parallel to the bottom 116; and any deflection in a direction substantially perpendicular to the bottom 116 be limited. For example, if a lower front edge 106 of the ram 118 moves vertically more than 0.125 inches, the teeth 138 (FIG. 3) will rise above the upper surface 140 of the plate 132, thereby providing a possibility for articles or optical discs to slide therebetween. To limit the vertical displacement of the ram 118, guides 180 are mounted to the sidewalls 114 immediately above the ram upper surface 124. Thus, the guides 180 limit the vertical displacement of the ram front surface 128 throughout the displacement of its full reciprocating stroke. Referring to FIG. 5, the guides 180 have elongated mounting holes 182 that permit the guide 180 to be adjusted so that the desired spacing is achieved between the ram upper surface 124 and the guide bearing surface 184. The guide 180 is made from any appropriate material providing the desired high strength and low friction, for example, a 954 aluminum-bronze alloy.

Figure 1B:
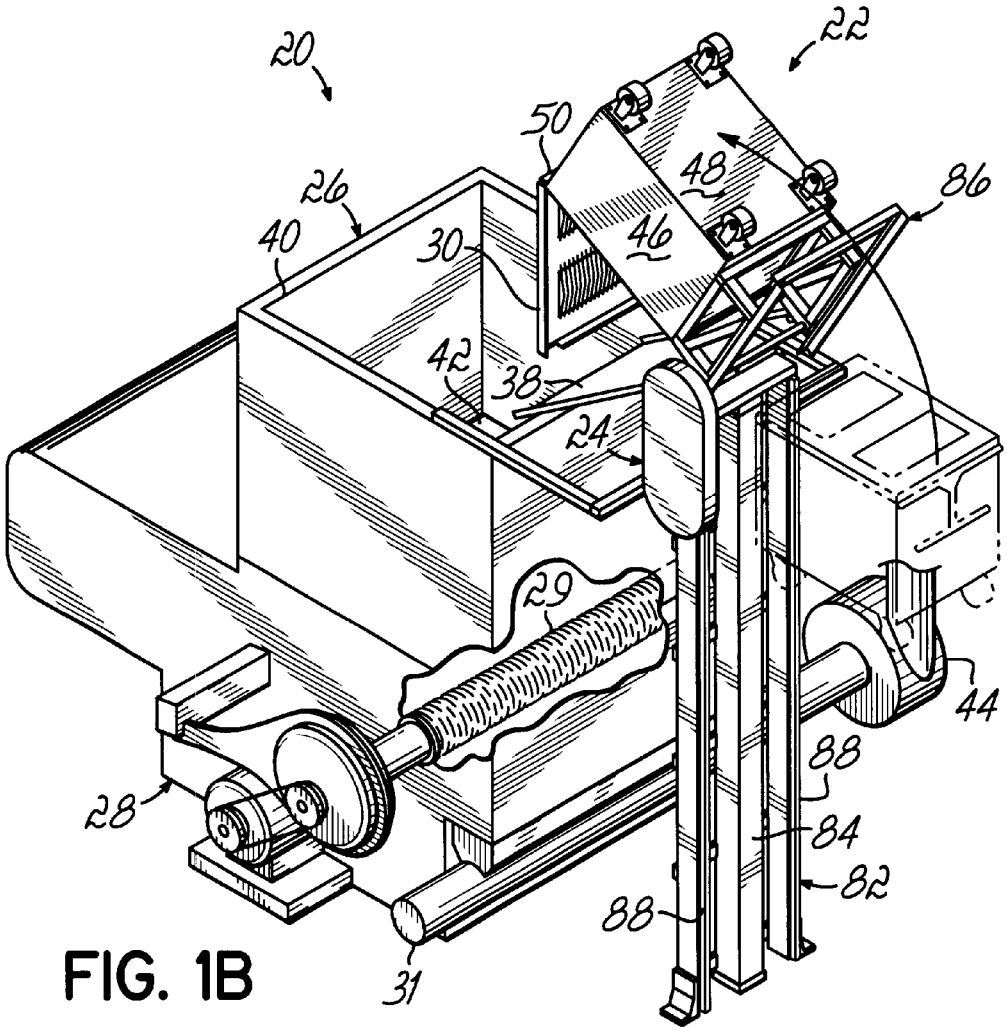
FIG. 1B is a perspective view of the article disposal system of FIG. 1A illustrating the wheeled cart being lifted to a position permitting articles therein to be discharged.
Figure 6:
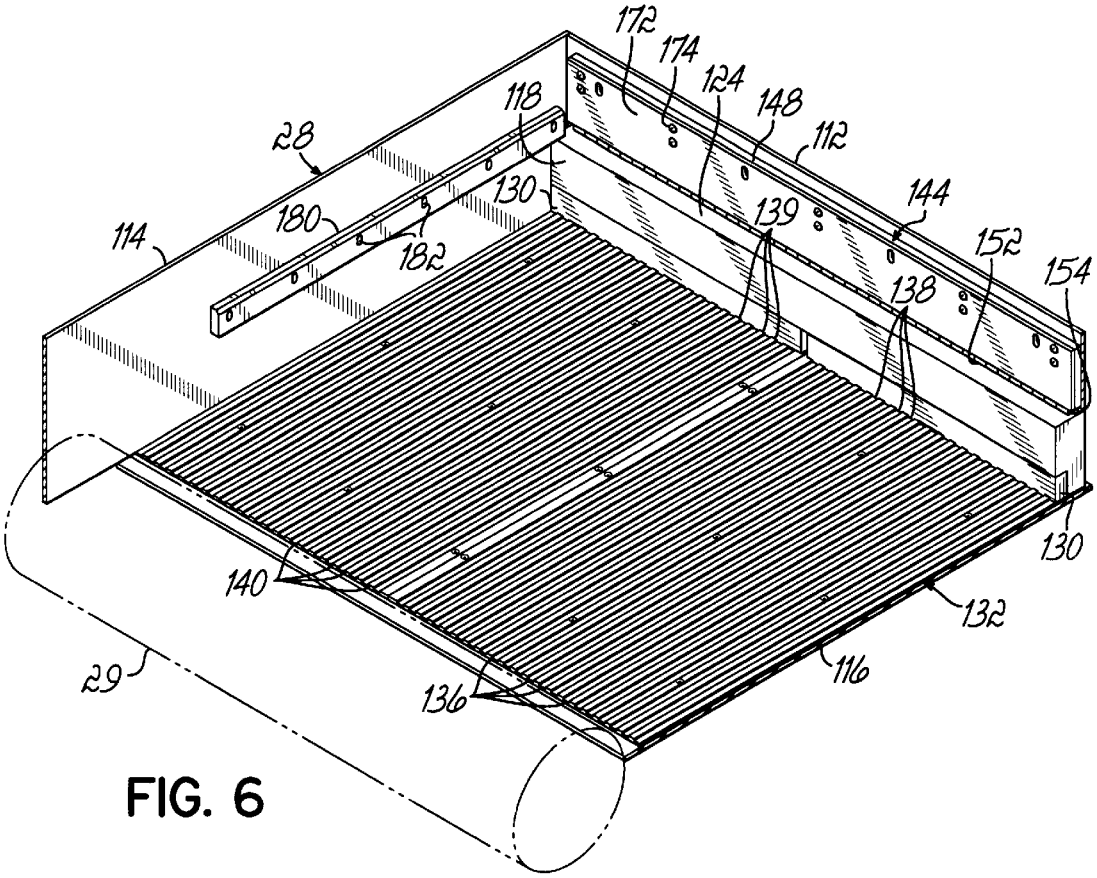
FIG. 6 is a perspective view illustrating the use of the seals of FIGS. 3 and 4 with the cutting apparatus of FIG. 2.

In use, the hopper 26 is filled with articles or optical discs as described with respect to FIG. 1A; and those optical discs are discharged into the chamber 108 as shown in FIG. 1B. At the appropriate times, the operation of the ram 118 and cutting tool 28 are initiated in a known manner. Referring to FIG. 6, as the ram 118 moves toward the cutting tool 29, that is, to the left as viewed in FIG. 6, the guides 180 (only one of which is shown in FIG. 6) maintain the ram 118 along a desired path with a minimum of displacement away from the top 140 of the grooved plate 132. Thus, the teeth 138 of the wiper 134 remain disposed in the grooves 136 of the plate 132. Hence, it is physically impossible for optical discs to slide beneath the ram 118 as it moves toward the cutting tool 29. In addition, the wiper teeth 152 of the segmented seal 144 maintain continuous contact across the full width of the ram upper surface 124. Thus, again, it is very difficult if not impossible for articles or optical discs to slide over the ram 118.

Thus, the apparatus of the present invention provides an improved machine for the handling and destroying of thin articles such as optical discs. The feeding of optical discs by a ram 118 through a chamber 108 and into a cutter or grinder 29 is substantially more reliable than known feeding devices. The apparatus of the present invention prevents thin optical discs from escaping from a working volume of the grinding machine 28. Thus, the apparatus of the present invention operates more efficiently to reliably handle and destroy all of the optical discs loaded into the machine.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, a grinder is used as a cutting tool for destroying the optical discs. As will be appreciated, other implements may be used to destroy the discs. The invention may be used with any apparatus having a ram-type feed for moving articles into an article destroyer.

Referring to FIG. 4, each of the wiper teeth 152 are biased by a compression spring 158; however, as will be appreciated, other biasing elements may be used, for example, a flat spring that extends over a plurality of the teeth 152. In other applications in which the teeth wipe over a machined and/or flat surface, the biasing elements 158 may be omitted. Further, instead of the pins 168 being fixed in the teeth 152 and movable in the slots 170 in the backing plate 140, the pins 168 may be fixed in the backing plate 148 and movable in slots in the teeth 152. Alternatively, the cover 172 and backing plate 148 may be a unitary piece into which the wiper teeth 152 are inserted prior to being secured therein by pins 168. In that embodiment, the teeth may be slotted to permit relative motion. In other embodiments, the chamfer 154 may be eliminated. While the teeth are described as being about one inch wide, the width, and hence, the number of the teeth may be varied to suit a particular application.

Therefore, the invention in its broadest aspects is not limited to the specific details shown and described. Consequently, departures may be made from the details described herein without departing from the spirit and scope of the claims which follow.

What is claimed is:

1. An apparatus for destroying articles comprising:

a chamber having at least one side wall, a bottom surface, an input opening adapted to receive the articles to be destroyed and a feed opening;

an article destroyer rotatably mounted adjacent the feed opening of the chamber;

a ram operatively mounted adjacent the bottom surface of the chamber and being movable in a first direction, the ram adapted to push the articles into the article destroyer, the ram having an upper surface located immediately below the rear wall of the chamber;

a first plate disposed in the chamber to form the bottom surface of the chamber, the plate having a plurality of grooves extending in the first direction;

a first wiper mounted on the ram, the first wiper having a plurality of teeth disposed in the plurality of grooves in the plate, the plurality of teeth being disposed in the plurality of grooves to prevent an article from sliding beneath the ram as it pushes articles into the article destroyer;

a second plate mounted on the upper surface of the ram, the second plate having a plurality of second grooves extending in the first direction; and a second wiper mounted on the one side wall, the second wiper having a plurality of second teeth, each of the second teeth being disposed in one of the second grooves, the plurality of second teeth being movable along respective second grooves by movement of the ram in the first direction, the plurality of second teeth being disposed in the second grooves to prevent an article from sliding between the one wall and the upper surface of the ram as it pushes articles into the article destroyer.

2. The apparatus of claim 1 further comprising a pair of solid metal guides mounted on opposing second and third side walls of the chamber immediately above the upper surface of the ram, the metal guides preventing the ram from raising upward while pushing articles into the article destroyer.

3. An apparatus for destroying articles comprising:

a chamber having at least one side wall, a bottom surface, an input opening adapted to receive the articles to be destroyed and a feed opening;

an article destroyer rotatably mounted adjacent the feed opening of the chamber;

a ram operatively mounted adjacent the bottom surface of the chamber and being movable in a first direction, the ram having a forward surface adapted to push the articles into the article destroyer, the ram having an upper surface located immediately below the one side wall of the chamber;

a plate disposed in the chamber to form the bottom surface of the chamber, the plate having a plurality of grooves extending in the first direction;

a wiper mounted on the ram, the wiper having a plurality of teeth, each of the teeth being disposed in one of the grooves in the plate, the plurality of teeth being disposed in the grooves to prevent an article from sliding beneath the ram as it pushes articles into the article destroyer; and a segmented wiper mounted on the one side wall, the segmented wiper having a length extending substantially parallel to the forward surface and across the upper surface of the ram, the segmented wiper being in substantially continuous contact with the upper surface of the ram to prevent an article from sliding between the upper surface of the ram and the one side wall as the ram pushes articles into the article destroyer.

4. The apparatus of claim 3 wherein the segmented wiper further comprises:

a frame; and a plurality of wiper teeth disposed in the frame in a side-by-side arrangement, at least some of the plurality of wiper teeth being independently movable with respect to others of the plurality of wiper teeth in the frame.

5. The apparatus of claim 4 wherein the some of the plurality of wiper teeth are independently movable in a first direction toward and away from the upper surface.

6. The apparatus of claim 5 wherein the some of the plurality of wiper teeth are resiliently biased in the first direction toward the upper surface.

7. The apparatus of claim 4 wherein each of the plurality of the wiper teeth are independently movable with respect to each of the others of the plurality of wiper teeth.

8. The apparatus of claim 7 wherein each of the plurality of wiper teeth are resiliently biased in the first direction toward the upper surface.

9. The apparatus of claim 8 wherein each of the plurality of wiper teeth are resiliently biased in the first direction substantially perpendicular to the upper surface.

10. The apparatus of claim 9 wherein each of the plurality of wiper teeth comprises a wiping edge.

11. The apparatus of claim 4 further comprising a plurality of biasing elements, each of the biasing elements operatively contacting a different one of the plurality of wiper teeth for resiliently biasing each of the plurality of wiper teeth in the first direction toward the upper surface.

12. The apparatus of claim 11 wherein each of the biasing elements further comprises a compression spring.

13. The apparatus of claim 4 further comprising:

a frame having a plurality of guide slots; and a plurality of guide pins having one end mechanically coupled to a respective wiper tooth and an opposite end disposed in a respective guide slot, the plurality of guide slots guiding and limiting motion of respective wiper teeth in a first direction toward and away from the upper surface.

14. The apparatus of claim 13 wherein the plurality of slots has a length about equal to a desired displacement of the plurality of teeth in the first direction.

15. The apparatus of claim 13 further comprising a plate covering the plurality of wiper teeth and the plurality of biasing elements and connected to the frame for securing the plurality of wiper teeth and the plurality of biasing elements in the frame.

16. An apparatus for destroying articles comprising:

a chamber having a rear wall, a bottom surface, an input opening adapted to receive the articles to be destroyed and a feed opening;

a cutter rotatably mounted adjacent the feed opening of the chamber;

a ram operatively mounted adjacent the bottom surface of the chamber and being movable in a first direction, the ram having a forward surface adapted to push the articles into the cutter, the ram having an upper surface located immediately below the rear wall of the chamber; and a segmented wiper mounted on the rear wall and having a length extending parallel to the forward surface and across the upper surface of the ram, the segmented wiper being in substantially continuous contact across the upper surface of the ram to prevent an article from sliding between the upper surface of the ram and the rear wall as the ram pushes articles into the cutter.

17. The apparatus of claim 16 wherein the segmented wiper further comprises:

a frame;

a plurality of wiper teeth disposed in the frame in a side-by-side arrangement, each of the plurality of wiper teeth being independently movable and having a wiping edge disposed on the irregular upper surface.

18. The apparatus of claim 16 further comprising a biasing element mechanically connected to each of the plurality of the wiper teeth for biasing each of the plurality of wiper teeth in the first direction toward the upper surface.

19. An apparatus for destroying optical discs comprising:

a chamber having side walls, a bottom surface, an input opening adapted to receive the optical discs to be destroyed and a feed opening;

a grinder rotatably mounted adjacent the feed opening of the chamber;

a ram operatively mounted adjacent the bottom surface of the chamber and being movable in a first direction, the ram adapted to push the optical discs into the grinder, the ram having an upper surface located immediately below a first side wall of the chamber;

a plate disposed in the chamber to form the bottom surface of the chamber, the plate having a plurality of grooves extending in the first direction;

a wiper mounted on the ram, the wiper having a plurality of teeth, each of the teeth being disposed in one of the grooves in the plate, the plurality of teeth being movable in respective grooves by movement of the ram in the first direction, the plurality of teeth disposed in the grooves prevent an optical disc from sliding beneath the ram as it pushes articles into the grinder; and a wiper mounted on the first side wall and having a length extending across the upper surface of the ram, the wiper having a plurality of wiper teeth extending along its length, each of the plurality of wiper teeth being independently movable into contact with the upper surface of the ram to prevent an optical disc from sliding between the upper surface of the ram and the first side wall as the ram pushes articles into the grinder.

20. The apparatus of claim 19 further comprising a pair of solid metal guides mounted on opposing second and third side walls of the chamber immediately above the upper surface of the ram, the metal guides preventing the ram from raising upward while pushing optical discs into the grinder.

21. A method of destroying articles using a cutter rotatably mounted adjacent a feed opening of a chamber, the chamber having side walls and a bottom surface and adapted to receive the articles to be destroyed through an input opening and to discharge destroyed articles through the feed opening, the articles being pushed into the cutter by a forward surface of a ram operatively mounted adjacent the bottom surface of the chamber and being movable in a first direction toward the cutter, the method comprising:

providing a first plate at the bottom surface of the chamber and a second plate on an upper surface of the ram, the first and second plates having respective first and second pluralities of plate grooves in respective surfaces extending in the first direction;

providing a first wiper mounted on the ram and a second wiper mounted on a side wall of the chamber, the first and second wiper having respective first and second pluralities of teeth disposed in the respective first and second pluralities of plate grooves;

moving the ram, the first wiper with the first plurality of teeth, the second plate and articles being pushed by the ram in the first direction toward the cutter, the first plurality of teeth and the second plate being movable in the first direction with the ram to prevent an article from sliding between the ram and the bottom surface and the upper surface of the ram and the side wall as the ram pushes the articles into the cutter.

22. A method of claim 21 further comprising:

providing a plurality of wiper teeth mounted on a first side wall and extending across an upper surface of the ram;

biasing each of the plurality of wiper teeth in a direction toward the upper surface;

wiping the upper surface of the ram with each of the plurality of wiper teeth as the ram moves in the first direction, thereby providing an independent wiping action on the upper surface of the ram by the plurality of wiper teeth to prevent an article from sliding between the upper surface of the ram and the first side wall as the ram pushes articles into the cutter.

23. A method of destroying articles using a cutter rotatably mounted adjacent a feed opening of a chamber, the chamber having side walls and a bottom surface and adapted to receive the articles to be destroyed through an input opening and to discharge destroyed articles through the feed opening, the articles being pushed into the cutter by a forward surface of a ram operatively mounted adjacent the bottom surface of the chamber and being movable in a first direction toward the cutter, the method comprising:

providing a segmented wiper being in substantially continuous contact across the upper surface of the ram; and moving the ram and articles being pushed by the ram in the first direction toward the cutter, the segmented wiper being disposed against the upper surface of the ram to prevent an article from sliding between the side wall and the upper surface of the ram as the ram pushes the articles into the cutter.

24. A method of claim 23 further comprising:

providing a plurality of wiper teeth stationarily mounted on a first side wall and extending across an upper surface of the ram;

biasing each of the plurality of wiper teeth in a direction toward the upper surface of the ram;

wiping the upper surface of the ram with each of the plurality of wiper teeth as the ram moves in the first direction, thereby providing an independent wiping action on the upper surface of the ram by the plurality of wiper teeth to prevent an article from sliding between the upper surface of the ram and the first side wall as the forward surface of the ram pushes articles into the cutter.

* * * * *

UNITED STATES PATENT AND TRADEMARK OFFICE

CERTIFICATE OF CORRECTION

PATENT NO. : 6,575,389 B2
DATED : June 10, 2003
INVENTOR(S) : Neely

It is certified that error appears in the above-identified patent and that said Letters Patent is hereby corrected as shown below:

Column 10,
Line 1, "second wiper" should read -- second wipers --.
Line 34, "providing a segmented wiper being" should read -- providing a segmented wiper mounted on one of the side walls and having a length extending parallel to the forward surface and across an upper surface of the ram, the segmented wiper being --.

Signed and Sealed this

Sixth Day of January, 2004

JAMES E. ROGAN
*Director of the United States Patent and Trademark Office*